US006474849B2

(12) United States Patent
Wu

(10) Patent No.: US 6,474,849 B2
(45) Date of Patent: Nov. 5, 2002

(54) STRUCTURE FOR SEPARABLE LAMP COVER

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/782,019

(22) Filed: Feb. 14, 2001

(65) Prior Publication Data

US 2002/0109997 A1 Aug. 15, 2002

(51) Int. Cl.[7] ..... F21V 17/00; F21V 1/06
(52) U.S. Cl. ..... 362/450; 362/352; 362/358
(58) Field of Search ..... 362/351, 352, 362/377, 450, 358; D26/24

(56) References Cited

U.S. PATENT DOCUMENTS 2,005,531 A * 6/1935 Brandstein ..... 150/52
2,813,053 A * 11/1957 Tuomala ..... 154/110
3,435,205 A * 3/1969 Paul ..... 240/108
3,787,676 A * 1/1974 Korach ..... 240/108 R
4,075,684 A * 2/1978 Witz ..... 362/352
4,212,052 A * 7/1980 Chambard ..... 362/352
4,354,222 A * 10/1982 Gall ..... 362/352
4,383,291 A * 5/1983 Gall ..... 362/352
5,375,048 A * 12/1994 Barnes ..... 362/352

FOREIGN PATENT DOCUMENTS

DE 201 07 160 U1 * 9/2001 ..... F21V/1/06

* cited by examiner

*Primary Examiner*—Alan Cariaso
*Assistant Examiner*—Sharon Payne
(74) *Attorney, Agent, or Firm*—Troxell Law Office PLLC

(57) ABSTRACT

An improved structure for a separable lamp cover having a top ring on the very top of the lamp cover, a bottom ring equipping an opening on the appropriate location, and support frames connecting the top ring and the bottom ring. Near the support portion of a support frame, there are radially extending support bars with clip hooks. After the assembly of the support frames, the upper transversal arch bars engage the clip hooks. The bottom of the support frame has clip elements with pierced holes through which is inserted on the bottom ring. On both sides of the support frame, the bottom ring has punched convex stoppers to constrain the movement of the support.

2 Claims, 5 Drawing Sheets

STRUCTURE FOR SEPARABLE LAMP COVER

BACKGROUND OF THE INVENTION

1. Field of the Invention

The invention relates to an improved structure for separable lamp covers. Near the ends of support bars, the top ring is bent upward to form clip hooks for the fixture of the ring rim. The upper transversal arch bars on the support frame engage the clip hooks on the top ring to constrain the movement of the support frame. The bottom of the support frame is punched to form clip elements with piercing holes, through which pass the bottom ring. On the bottom ring, there are punched flat convex stoppers on both sides of the support frame to constrain the movement of the support frame. The lamp cover can thus be easily assembled and occupy minimum volume to achieve the objectives of easy assembly, and to reduce storage volume and delivery cost.

2. Description of the Prior Art

Please refer to FIG. 5, which illustrates the traditional lamp cover 5. Most of the support frames are directly connected to the top ring and the bottom ring to form lamp cover structures. However, due to the structural drawbacks, there are many practical defects for this kind of lamp cover structure. Further improvement and development are needed. The defects are further described as follows.

The prior lamp covers form a certain structural shape, therefore, the lamp covers cannot be compressed during delivery and the products take too much space. The storage and delivery volume for this kind of product cannot be reduced, hence the delivery cost is raised. It leads to cost increase.

On the basis of thorough research for constant improvement, the inventor finally developed the invention, a lamp cover for easy assembly and great improvement in practical usage.

SUMMARY OF THE INVENTION

The primary objective of the invention is to provide an improved structure for separable lamp covers, which comprises a top ring, a bottom ring, and a support frame. Near the support portion of the support frame, the to ring has radially extending support bars with clip hooks. After the assembly of the support frame, the upper transversal arch bars on the support frame engage the clip hooks. The bottom of the support frame is punched to form clip elements with piercing holes, through which pass the bottom ring. On the bottom ring, there are punched flat convex stoppers on both sides of the support frame to constrain the movement of the support frame. During assembly, one may rotate the support frame to reach a horizontal state. The lamp cover can thus be assembled with minimum volume to achieve the objectives of easy assembly and to reduce storage volume and delivery cost.

The followings are brief description and legend for optimal embodiments of the invention for committee's better understanding in the structural characteristics and operations of the invention.

DETAILED DESCRIPTION OF THE PREFERRED EMBODIMENT

Figure 1:
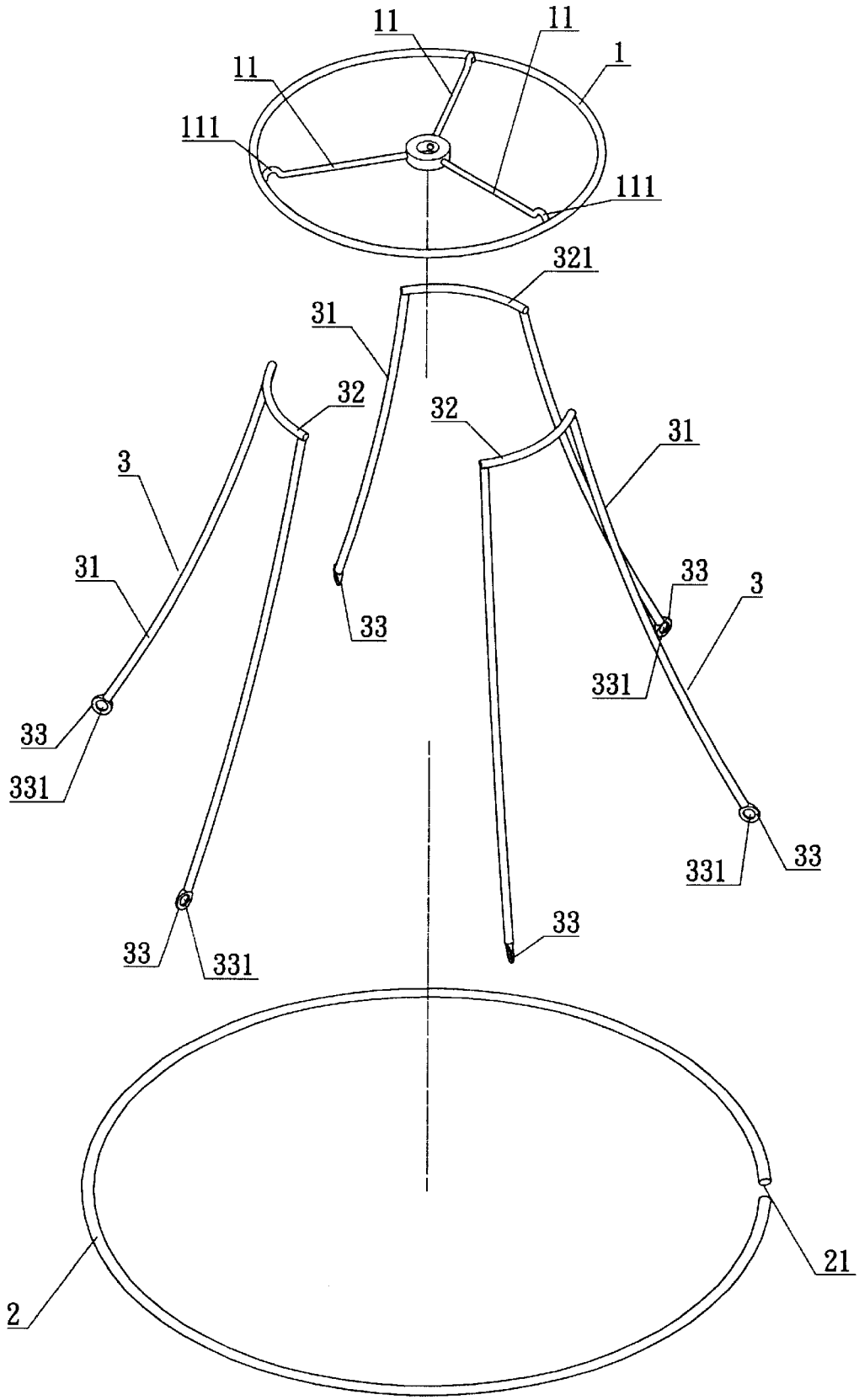
FIG. 1 is an exploded drawing of the invention.
Figure 2A:
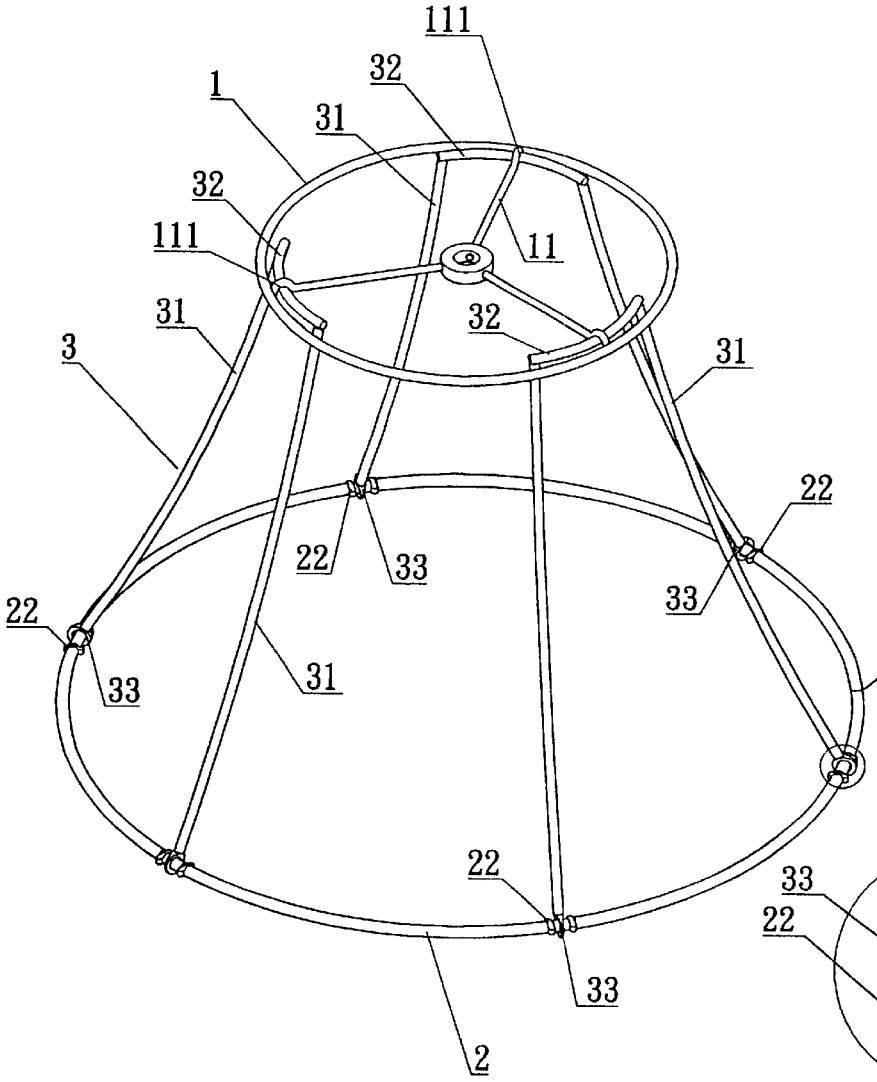
FIG. 2A is an isometric assembly drawing of the invention.
Figure 2B:
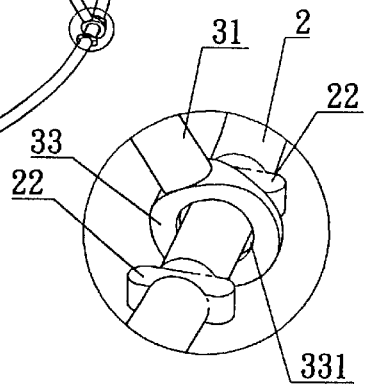
FIG. 2B is an enlarged planar drawing of the bottom ring and the support portion on the support frame.

Please refer to FIGS. 1–4B for the structure of the invention, which comprises a top ring 1 on the very top of a lamp cover, a bottom ring 2, of which the perimeter is greater than that of the top ring, and support frames 3 connecting the top ring 1 and the bottom ring 2.

The top ring 1 made of metal is round in structure and mounts on the stand bar of a table lamp (not shown). The top ring 1 has radially extending support bars 11. The ends of the bars are bent upwardly to form clip hooks 111, which fix the rim of the to ring to connect and interlock with the support frames 3.

At a proper location on the bottom ring 2, there is an opening 21, which allows the support frames 3 to pass. Also, on both sides of the clip element 33, the bottom ring has punched convex stoppers 22 to constrain the movement of the support frames 3. Finally, the opening on the bottom ring is welded.

The support frames 3 each comprise dual vertical arch bars 31 and an upper transversal arch bar 32, which matches the curvature of the top ring. After the assembly of the upper transversal arch bar 32 on the support frame, the upper transversal arch bars 32 engage clip hooks 111 on the ends of the support bars 11 to constrain the movement of the support frames. The bottoms of the support frames 3 are punched to form flat clip elements 33. The punching makes the clip elements 33 round in shape. Also, the center of each clip element 33 is punched to form a piercing hole 331 and to allow the penetration of the bottom ring 2.

Figure 3:
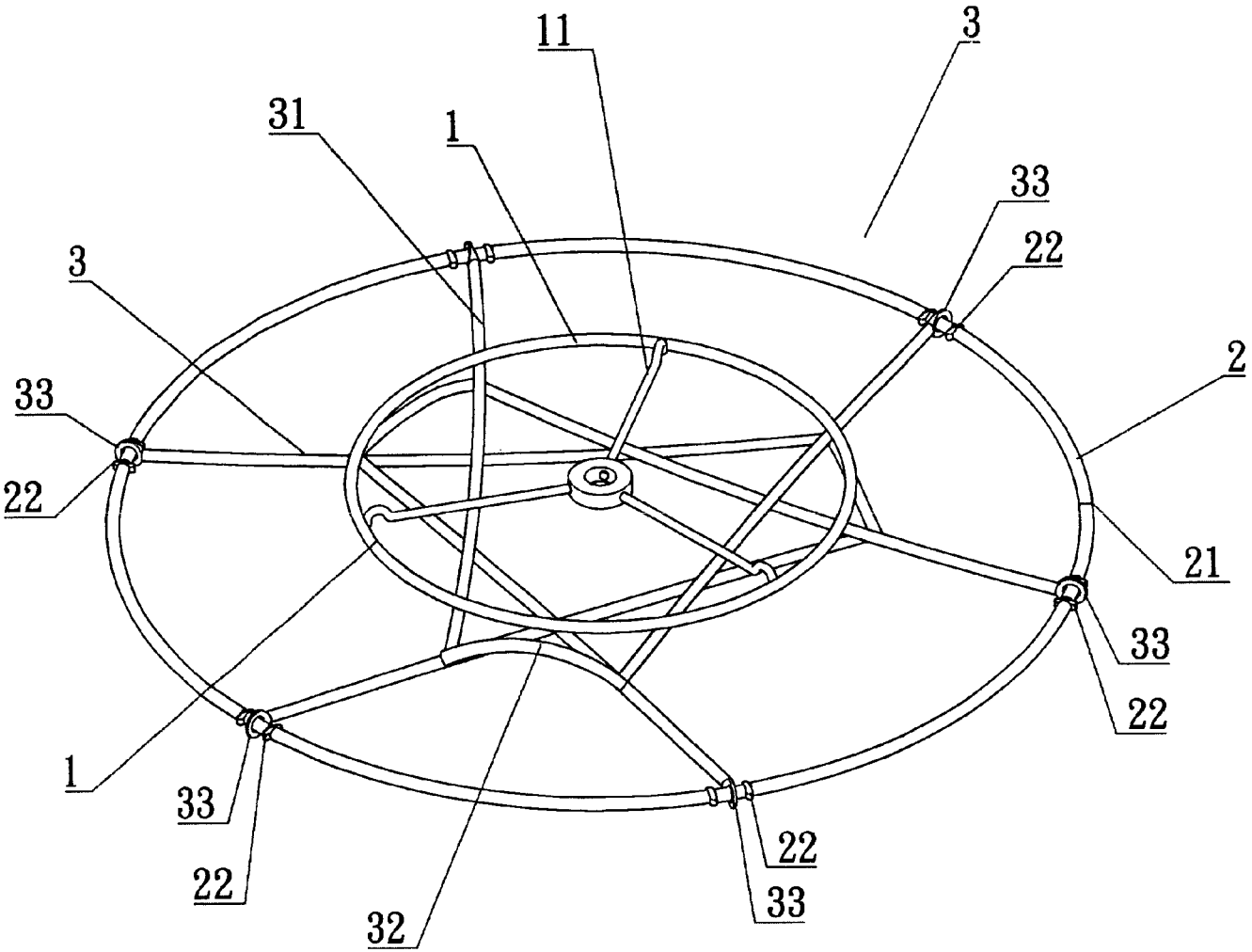
FIG. 3 is a folded and unfolded drawing of an embodiment for the invention.

Please refer to FIG. 3. The clip elements 33 on the support frame rotatably join the bottom ring 2 such that during the disassembly of the lamp cover, the support frames 3 can be rotated downward to reach a horizontal state. The lamp cover can thus be shipped with minimum volume to achieve the objectives of reducing storage volume and delivery cost.

Figures 4A, 4B:
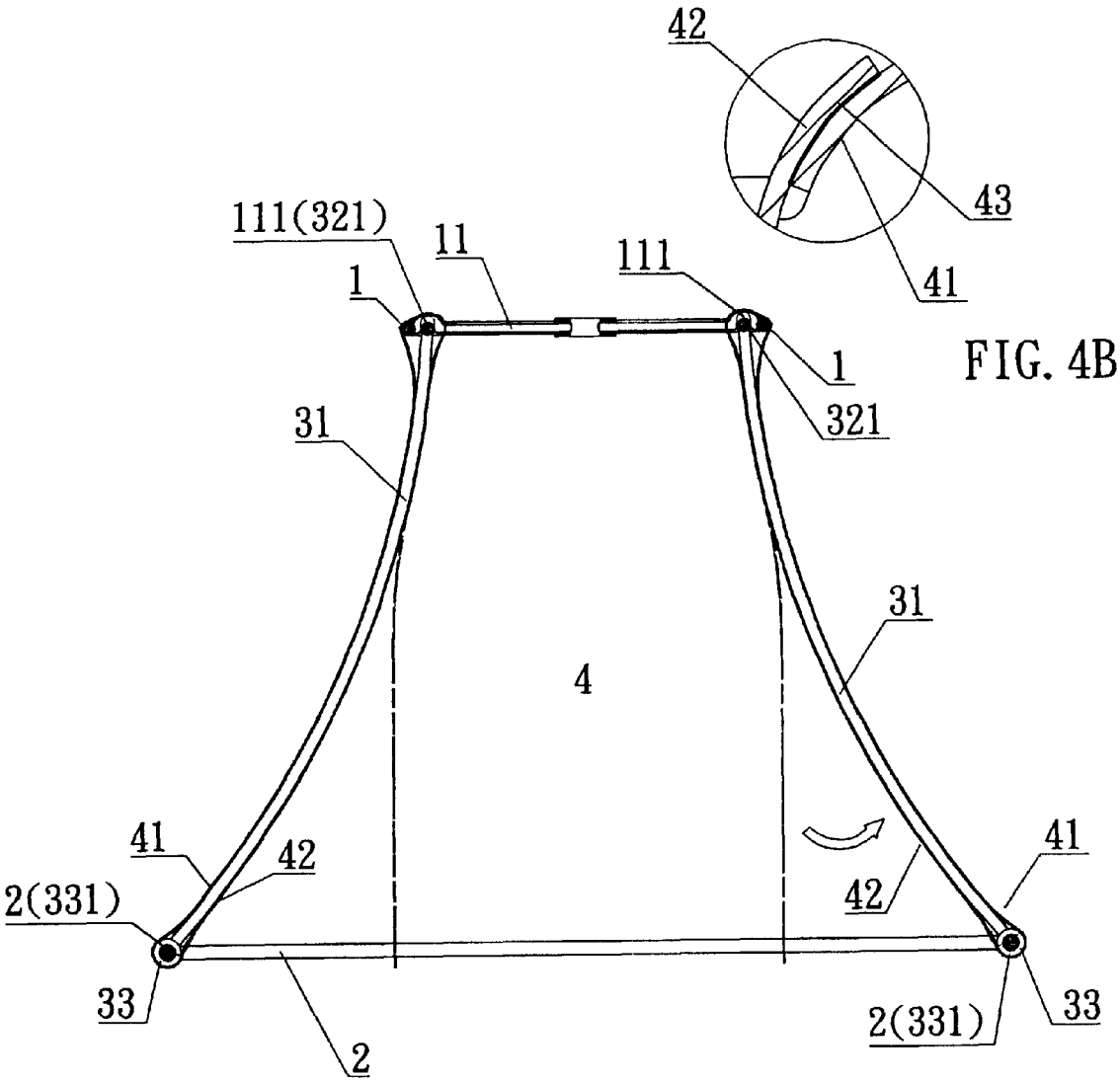
FIG. 4A is a planar drawing of the installation of lamp cover cloth for the invention.
FIG. 4B is an enlarged planar drawing of the adhesion portion for the invention.
Figure 5:
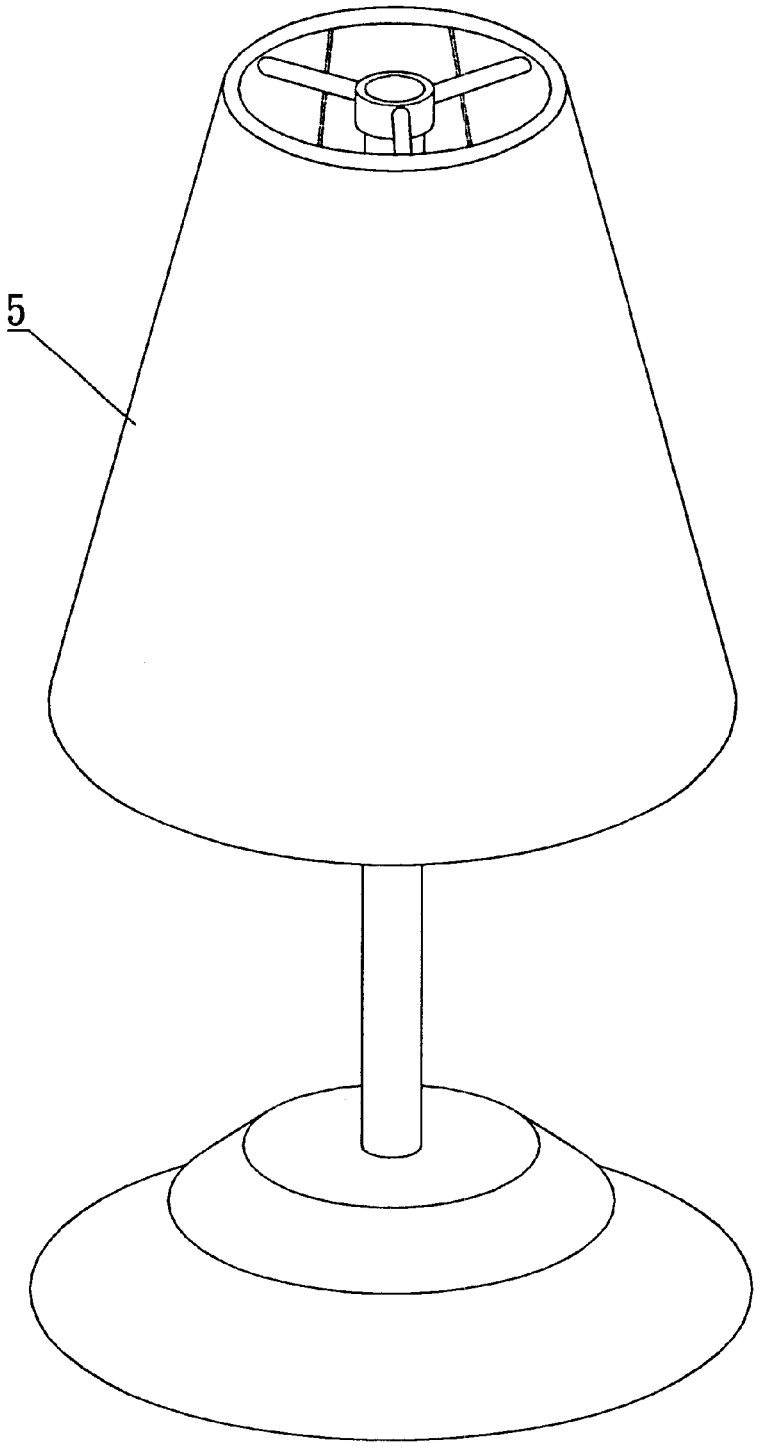
FIG. 5 PRIOR ART
FIG. 5 is an isometric drawing of the prior product.

Please refer to FIGS. 4A and 4B. After the assembly of frame base for the lamp cover, a cloth lamp cover 4 can be covered on the exterior area between the top ring 1 and the bottom ring 2. For the lamp cover 4, one may make the exterior cloth 41 tight in advance and fasten it on the rim of the support frames 3, then, lay an inner-layer cloth 42 on the interior of the support frames 3. On the appropriate locations, there are adhesion bandages 43 on the inner and exterior cloth to wrap the support frame. The frame is not exposed and the structure of combined cloth is formed for the effect of esthetics. The frame base can also be folded together with the lamp cover 4 to reduce storage volume and to decrease delivery cost.

The above explanation is a substantial embodiment of the invention, which provides greater practical performance and simplification than products of prior art.

What is claimed is:

1. A separable lamp cover, comprising: a top ring on a very top of the lamp cover; a bottom ring, of which a perimeter is greater than that of the top ring; and a plurality of support frames connecting the top ring and the bottom ring, wherein the top ring has radially extending support bars, ends of the bars being bent upwardly to form clip hooks; the support frames each having dual vertical arch bars and an upper transversal arch bar, which engages one of the clip hooks on the end of support bars to constrain movement of the support frame, a bottom of each support frame having punched flat clip elements having piercing holes through which the bottom ring passes, the bottom ring having, on both sides of the clip elements, flat convex stoppers to constrain movement of the support frames.

2. The separable lamp cover of claim 1 further comprising a cloth lamp cover covering an area between the top ring and the bottom ring and fastened onto the support frame, and including an external coth and an inner cloth on an interior of the support frame, adhesion bandages on the inner and external cloth to attach the lamp cover to the support frame.

* * * * *